US006829855B2

(12) United States Patent
Seifert

(10) Patent No.: US 6,829,855 B2
(45) Date of Patent: Dec. 14, 2004

(54) AMBIDEXTROUS RESERVE MAGAZINE HOLDER FOR A FIREARM

(76) Inventor: Ralph Arthur Seifert, 2891 Indiana St., W. Melbourne, FL (US) 32904

( * ) Notice: Subject to any disclaimer, the term of this patent is extended or adjusted under 35 U.S.C. 154(b) by 0 days.

(21) Appl. No.: 10/422,170

(22) Filed: Apr. 24, 2003

(65) Prior Publication Data

US 2003/0200693 A1 Oct. 30, 2003

Related U.S. Application Data

(60) Provisional application No. 60/375,893, filed on Apr. 27, 2002.

(51) Int. Cl.[7] ..... F41C 23/22

(52) U.S. Cl. ..... 42/90; 42/71.01; 42/72; 42/85; 89/1.42

(58) Field of Search ..... 42/71.01, 72, 85, 42/90; 89/1.42

(56) References Cited

U.S. PATENT DOCUMENTS

| | | | | | |
|---|---|---|---|---|---|
| 1,517,420 | A | * | 12/1924 | Fritz | 42/71.01 |
| 2,931,120 | A | * | 4/1960 | Kolin | 42/18 |
| 3,380,182 | A | * | 4/1968 | Browning | 42/75.03 |
| 3,618,248 | A | * | 11/1971 | Into et al. | 42/71.01 |
| 3,638,344 | A | * | 2/1972 | Wagner et al. | 42/71.01 |
| 3,939,590 | A | * | 2/1976 | Musgrave | 42/90 |
| 4,100,694 | A | | 7/1978 | Musgrave | 42/90 |
| 4,115,943 | A | | 9/1978 | Musgrave | 42/90 |
| 4,484,404 | A | | 11/1984 | Johnson | 42/90 |
| 4,512,101 | A | * | 4/1985 | Waterman, Jr. | 42/71.01 |
| 4,570,370 | A | * | 2/1986 | Smith et al. | 42/90 |
| 4,570,371 | A | * | 2/1986 | Mears | 42/90 |
| 4,628,627 | A | | 12/1986 | Johnson | 42/90 |
| 4,688,344 | A | * | 8/1987 | Kim | 42/50 |
| 4,697,367 | A | * | 10/1987 | Brophy | 42/71.01 |
| 4,850,127 | A | * | 7/1989 | Davis et al. | 42/71.01 |
| 4,882,973 | A | * | 11/1989 | Piscetta | 89/1.41 |
| 4,944,109 | A | * | 7/1990 | Zedrosser | 42/71.01 |
| 4,949,496 | A | * | 8/1990 | Stephan | 42/90 |
| 5,173,564 | A | * | 12/1992 | Hammond, Jr. | 42/75.03 |
| 5,225,613 | A | | 7/1993 | Claridge | 42/74 |
| 5,265,365 | A | * | 11/1993 | Finn | 42/74 |
| 5,636,465 | A | | 6/1997 | Johnson | 42/90 |
| 5,755,055 | A | * | 5/1998 | Thompson et al. | 42/71.01 |
| 5,924,233 | A | * | 7/1999 | Strobel | 42/72 |
| 6,250,194 | B1 | * | 6/2001 | Brandl et al. | 89/1.41 |
| 6,385,892 | B1 | * | 5/2002 | Vendetti | 42/86 |
| 6,418,656 | B1 | * | 7/2002 | Christiansen | 42/90 |
| 6,543,172 | B1 | * | 4/2003 | Armstrong | 42/71.01 |
| 6,662,485 | B2 | * | 12/2003 | Kay | 42/75.03 |

* cited by examiner

*Primary Examiner*—Jack Keith
*Assistant Examiner*—John Richardson
(74) *Attorney, Agent, or Firm*—John L. DeAngelis, Jr.; Beusse Brownlee Wolter Mora & Maire, P.A.

(57) ABSTRACT

A magazine-protecting, ambidextrous device for carrying a loaded spare magazine attached to a firearm buttstock in position for rapid removal and insertion into the firing position of the firearm. The loaded spare magazine is restrained within a well formed in the buttstock by a retractable latch pivotably mounted such that when the spare magazine is removed, the latch retracts below the exterior surface of the firearm buttstock, protecting the latch from damage and reducing the profile of the weapon. The spare magazine is carried in such a way as to protect the open end of the magazine and the ammunition carried therein from dirt and/or damage.

10 Claims, 4 Drawing Sheets

AMBIDEXTROUS RESERVE MAGAZINE HOLDER FOR A FIREARM

The present invention claims the benefit of the provisional patent application filed on Apr. 27, 2002, assigned application No. 60/375,893 and entitled Ambidextrous Reserve Magazine Holder.

FIELD OF THE INVENTION

The present invention is directed generally to reserve magazine holders for a firearm, and specifically to an ambidextrous reserve ammunition magazine holder.

BACKGROUND OF THE INVENTION

Many firearms use detachable ammunition cartridge magazines that can be quickly removed when empty and replaced with a full magazine. This is desirable not only to rapidly reload the firearm when the active magazine is depleted, but also to change to a different ammunition type by replacing the magazine cartridge as the target requires (armor piercing, tracer, etc). Although detachable magazine firearms are employed in a wide variety of applications, it is generally beneficial to minimize the time required to remove the empty magazine and replace it with the full magazine. Advantageously, certain firearms allow magazine replacement without releasing the grip of the firing hand, while the free hand simultaneously reaches for the replacement magazine. Ideally, the spare or reserve magazine should be readily available and easily inserted into the firearm.

Spare magazines can be carried in one or more pouches on the firearm operator's body, as is the practice of military personnel who carry these firearms full time as part of their mission. In other situations, such as police work or home defense, the firearm is stored in a secure location, the police cruiser for example, and retrieved only in emergency situations. However, during such emergency conditions, the need to grab both the firearm and a spare magazine significantly increases response time, and belting or slinging on a spare magazine carrier while holding and controlling a firearm is clumsy, time consuming, and possibly dangerous.

Firearms for use in law enforcement are often stored in close fitting, lockable weapons cases that lack sufficient space for bulky add-on magazines carriers or other firearm accessories. Home defense firearms are also stored in compact locations to avoid notice by the casual observer. Storage of spare magazines in such enclosures is not ideal and in some situations may not be practical.

Certain firearm designs provide for the storage of a spare magazine on the firearm. The advantages of a spare magazine carrier that is attached to the firearm, but does not increase that firearm bulk, are apparent. See for example the following patents issued to Johnson (U.S. Pat. Nos. 4,484,404; 4,628,627 and 5,636,465) and Musgrave (U.S. Pat. Nos. 4,100,694 and 4,115,943). In the Johnson and Musgrave patents, the spare magazine is carried in an add-on well affixed to the firearm, increasing the bulk of the firearm, even when the spare magazine is absent from the well. Note further that the magazine carrier add-on well disclosed by Johnson, and also utilized in commercial products, is positioned on one side of the firearm, limiting its utility for left handed shooters. Claridge (U.S. Pat. No. 5,225,613) discloses a spare magazine carried in a low profile orientation relative to the firearm, but removal of the magazine latch is a very slow and awkward process.

BRIEF SUMMARY OF THE INVENTION

A firearm having a buttstock constructed according to the teachings of the present invention includes a well within the buttstock for storing a spare magazine. A rotatable latch affixed to opposing surfaces of the buttstock releasably holds the spare magazine within the well.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
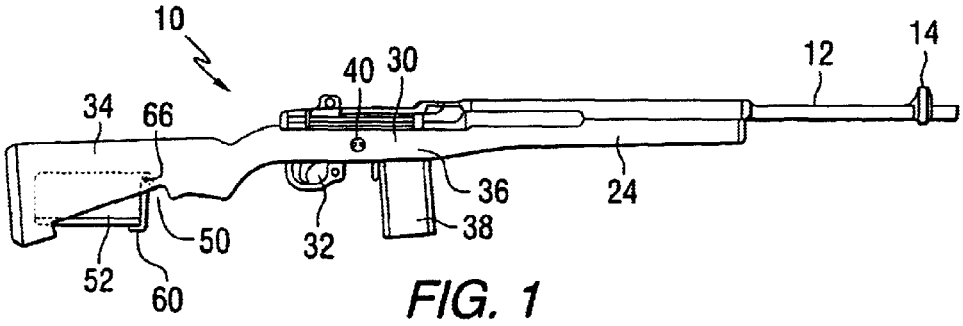
FIG. 1 illustrates an exemplary firearm constructed according to the teachings of the present invention.

Before describing in detail the reserve ammunition magazine holder in accordance with the present invention, it should be observed that the present invention resides primarily in a novel combination of hardware elements related to a magazine holder. Accordingly, the hardware elements have been represented by conventional elements in the drawings, showing only those specific details that are pertinent to the present invention, so as not to obscure the disclosure with structural details that will be readily apparent to those skilled in the art having the benefit of the description herein.

FIG. 1 illustrates a firearm 10 constructed according to the teachings of the present invention, comprising a barrel 12 and a sight bracket 14. A considerable length of the barrel 12 is concealed by a hand guard 24. The barrel 12 and the hand guard 24 are affixed to an anterior end of a receiver 30 as shown. A pistol grip 32 and a buttstock 34 are affixed to a posterior end of the receiver 30. A magazine receiver 36, located forward of the firing grip 32, carries a primary magazine 38. A magazine release button 40 when depressed, releases the primary magazine 38 from the firearm 10.

Solely for illustrative purposes, FIG. 1 illustrates a mini-14 firearm. However, the teachings of the present invention can be applied to other firearm types, with suitable modifications in dimensions and geometry without departing from the essential scope of the invention.

The invention comprises a protective well 50 formed in the buttstock 34 for removably holding a spare magazine 52 for the firearm 10. A rotatable latch 54 restrains the spare magazine 52 within the well 50. The spare magazine 52 is positioned relative to the shooter such that either a left-handed or a right-handed shooter can conveniently and easily remove the spare magazine 50 for insertion into the magazine receiver 36. By disposing the spare magazine 52 longitudinally within the well 50 (i.e., the longitudinal axis of the spare magazine 52 is parallel to the longitudinal axis of the firearm 10), the weight of the spare magazine 52 is distributed along the buttstock 34, creating a firearm weight distribution that is easier for the shooter to manage, when compared with the prior art magazine storage techniques that result in a forward-heavy firearm. That is, in the prior art designs the weight of the spare magazine tends to impart a rotational torque about the firearm's longitudinal center of gravity, making the firearm clumsy to carry and requiring the shooter to exert an opposing force when aiming and shooting the firearm. Note that according to the teachings of the present invention, the protective well 50 encloses the upper portion of the spare magazine 52, protecting the spare magazine 52 from damage to its feed lips (not shown) from which the ammunition is injected into the firearm, and also protecting the ammunition carried within the spare magazine 52 from damage and dirt. Since the protective well 50 is formed within the firearm buttstock 34, there is no substantial change to the firearm profile or bulk when the spare magazine 52 is stored within the well 50 or absent from the well 50.

Figure 2A:
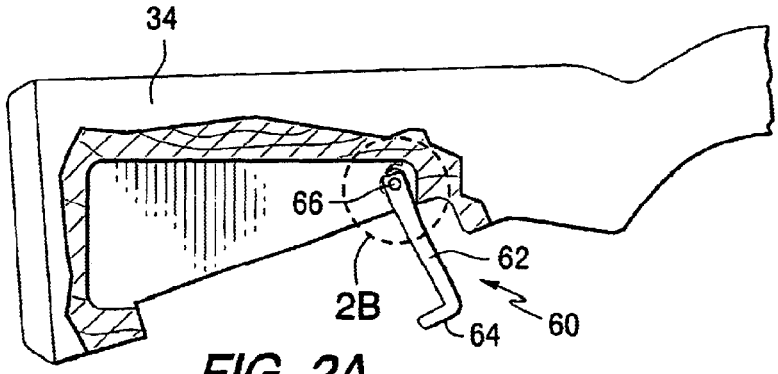
FIGS. 2A, 2B, 3 and 4 illustrate the spare magazine latch of the firearm of FIG. 1.
Figure 2B:
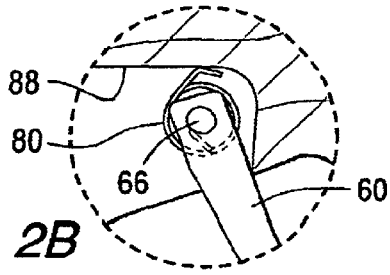
Figure 3:
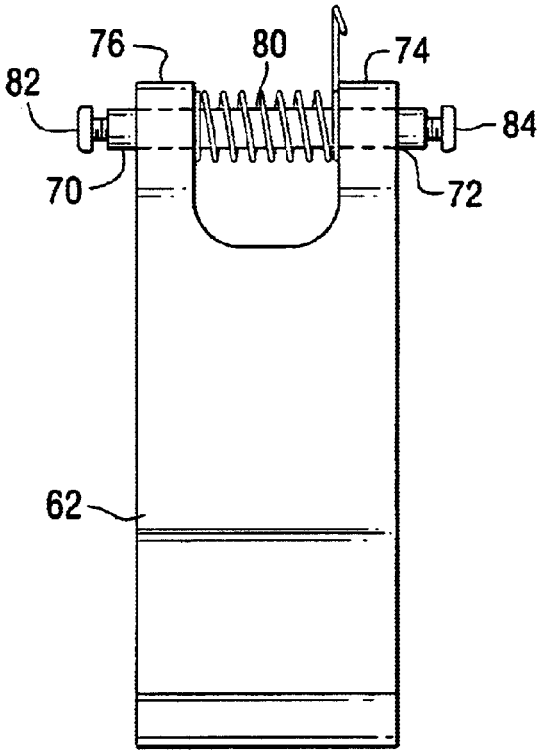
Figure 4:
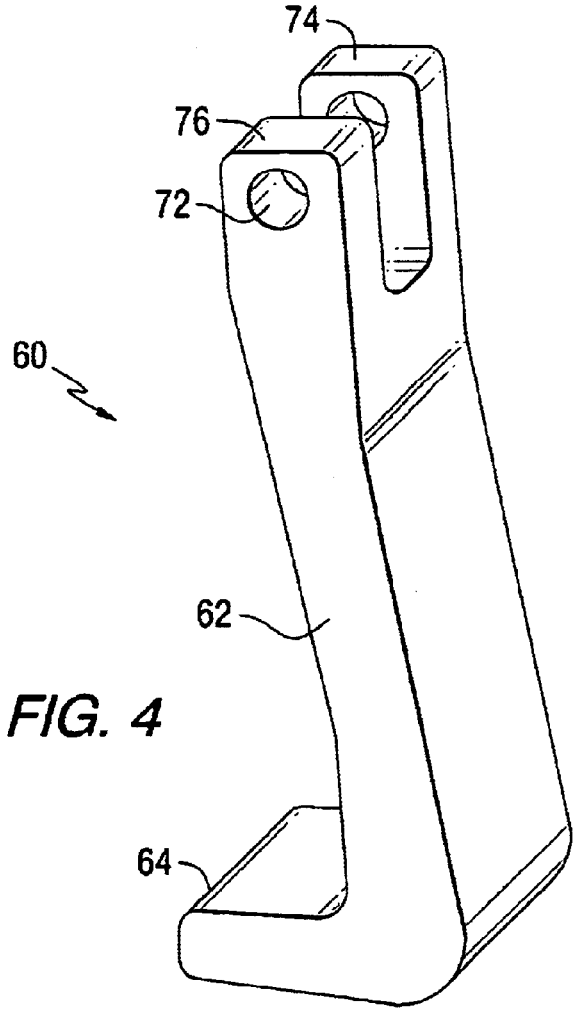

A biased latch 60, a generally L-shaped structure comprising an arm 62 and a tab 64 disposed at one end thereof, and pivotable about an axis 66, removably retains the spare magazine 52 in the protective well 50. See the FIG. 2A side view and the FIG. 2B close-up view. A front view of the latch 60 is illustrated in FIG. 3, showing a sleeve 70 frictionally engaged within a hole 72 in each of two arms 74 and 76 extending from the arm 62. In a preferred embodiment, a biasing spiral spring 80 encircles the sleeve 70. The latch 60 is rotatably affixed to the buttstock 34 by two opposing machine screws 82 and 84 that pass through opposing sides of the buttstock 34 for threadably engaging opposing ends of the sleeve 70.

When stored within the protective well 50, the spare magazine 52 exerts an opening force against the latch 60, opposing the bias force exerted by the spiral spring 80 and retaining the spare magazine 52 within the well 50. Specifically, the forward-facing and bottom-facing ends of the spare magazine 52 are captured by the arm 62 and the tab 64. When the spare magazine 52 is removed, the bias force of the spring 80 retracts the latch 60 into the protective well 50. From FIG. 2B, it can be seen that the bias force is applied by contact between the spring 80 and an adjacent surface 88 of the buttstock 34. With the latch retracted, the profile and bulk of the firearm 10 are essentially identical to that of a firearm lacking any magazine storage capabilities. Retraction of the latch 60 also protects the latch 60 from damage during firearm use.

Figure 5:
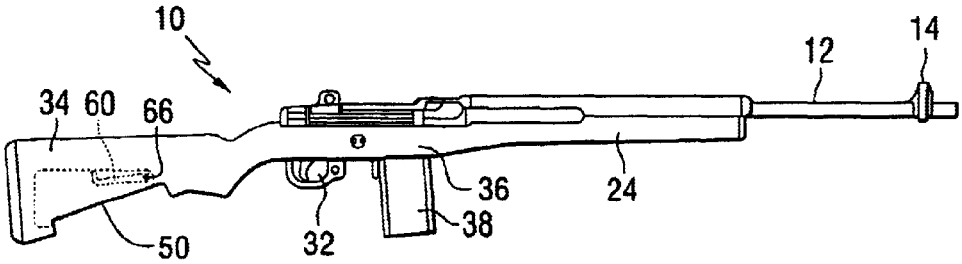
FIG. 5 illustrates the firearm of FIG. 1 with the spare magazine removed.

FIG. 5 illustrates the firearm 10 absent the spare magazine 52, with the latch 60 in a retracted position.

Operation

The spare magazine 52 is inserted into the protective well 50 by first rotating the latch 60 to the fully open position. The spare magazine 52 is then inserted, open end first, (i.e., the end from which the ammunition is discharged into the firearm 10) into the well 50, with the bottom surface of the magazine 52 facing in the direction of the barrel 12. The bottom surface is rotated upwardly and forward while the operator simultaneously exerts a force to slide the top surface back into the protective well 50. The operator continues this motion until the spare magazine 52 is sufficiently disposed within the protective well 50 to permit the latch 60 to engage the bottom corner of the spare magazine 52, removably securing the spare magazine 52 within the well 50.

When the shooter wishes to change from the primary magazine 38 to the spare magazine 52, he depress the magazine release button 40 with the first finger of his shooting hand, releasing the primary magazine 38 from the magazine well 36 of the firearm 10.

Figure 6A:
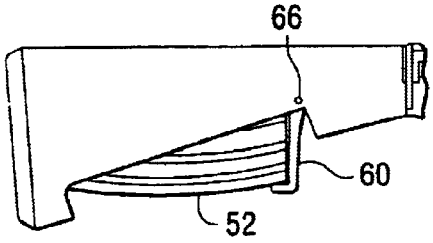
FIGS. 6A–6F are a succession of illustration depicting removal of the spare magazine from the well of the present invention.
Figure 6B:
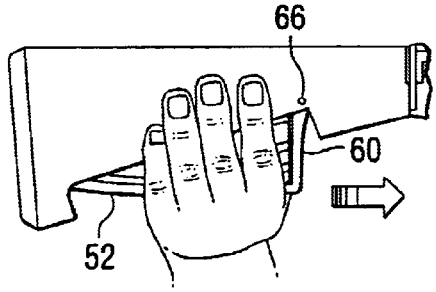
Figure 6C:
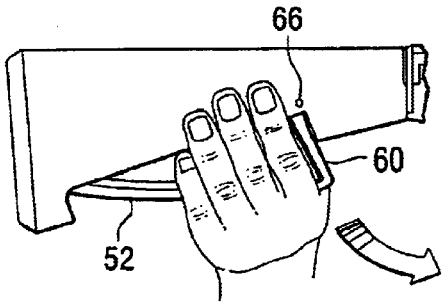
Figure 6D:
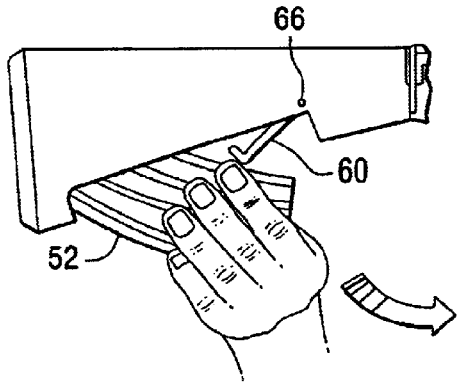
Figure 6E:
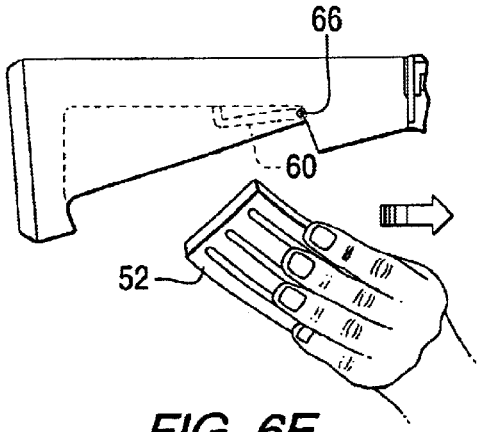
Figure 6F:
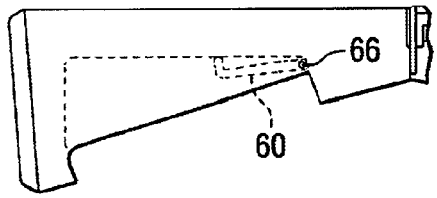

The process of removing a spare magazine 52 from the firearm 10 is illustrated in a series of operational illustrations in FIGS. 6A–6F. FIG. 6A illustrates the spare magazine 52 within the well 50. Simultaneous with the depression of the magazine release button 40, the shooter's free hand grasps the spare magazine 52 between thumb and fingers (see FIG. 6B) and pushes the latch 60 forward by moving his hand forward. As the latch 60 is pushed forward against the bias force, the spare magazine 52 is pulled forward and downward. See FIGS. 6C and 6D. As this motion continues, the spare magazine 52 is removed from the well 36 (See FIG. 6E.) and rotated into an upright position. The rotation places the spare magazine 52 in the correct orientation for insertion into the magazine well 36 of the firearm 10. With the force of the spare magazine now absent, the latch 60 retracts into the protective well 50 as shown in FIG. 6F.

Figure 7:
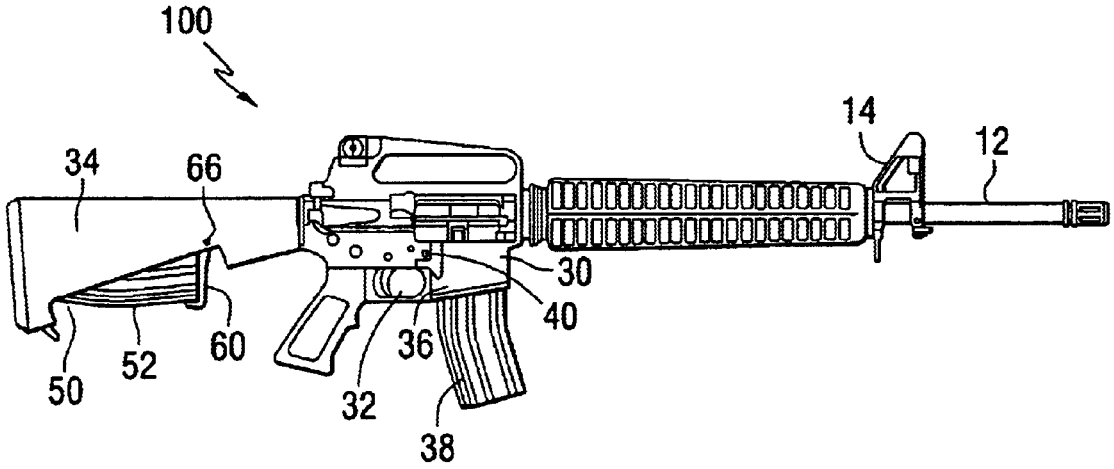
FIGS. 7 and 8 illustrate the teachings of the present invention as applied to a second exemplary firearm.
Figure 8:
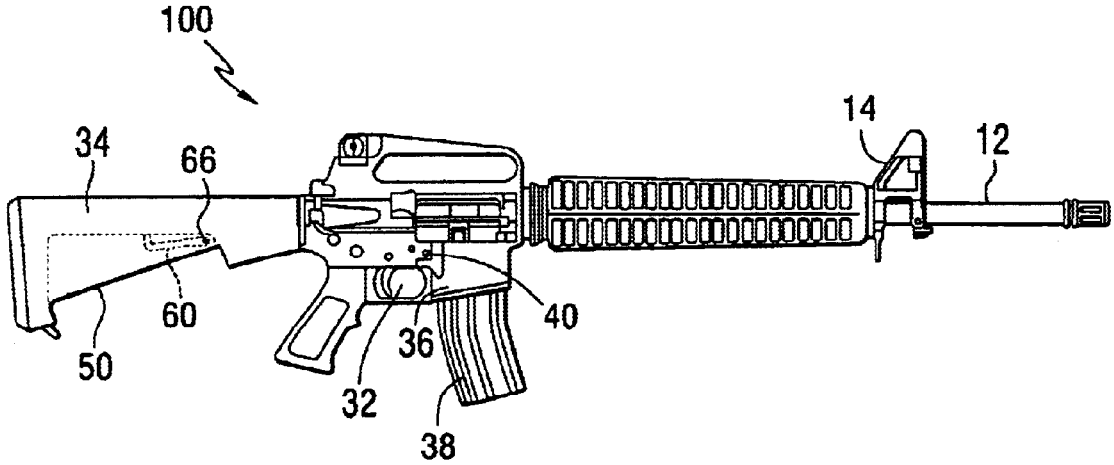

FIG. 7 illustrates the application of the teachings of the present invention to an AR-15 or M-16 firearm, referred to by reference character 100, including the protective well 50 and associated components of the present invention. FIG. 8 illustrates the firearm 100 with the spare magazine 52 removed.

An apparatus has been described as useful for storing a spare ammunition magazine for a firearm. While specific applications and examples of the invention have been illustrated and discussed, the principals disclosed herein provide a basis for practicing the invention in a variety of ways and in a variety of firearm. Numerous variations are possible within the scope of the invention. The invention is limited only by the claims that follow.

What is claimed is:

1. A firearm providing integral spare magazine storage, comprising:

a buttstock having a well formed in a bottom surface thereof, for receiving the spare magazine horizontally disposed within the well; and a pivotable latch disposed within the well for engaging the spare magazine to releasably secure the spare magazine within the well.

2. The firearm of claim 1 further comprising a bias member operative relative to the latch for applying a bias force to the latch to permit retraction of the latch into the well when the spare magazine is absent and for releasably holding the spare magazine within the well.

3. The firearm of claim 2 wherein the latch comprises an arm portion and a tab portion affixed thereto to form a substantially "L" shaped structure, wherein a first end of the arm portion is pivotably affixed to opposing surfaces of the buttstock.

4. The firearm of claim 3 wherein the arm portion further comprises opposing first and second sleeve engaging arms disposed at the first end of the arm portion, wherein the first and second sleeve engaging arms define an opening therein for receiving a sleeve, wherein the sleeve is rotatable within the opening of the first and second sleeve engaging arms.

5. The firearm of claim 4 wherein the sleeve is fixably attached to opposing surfaces of,the buttstock such that the latch is rotatable about the sleeve.

6. The firearm of claim 5 further comprising a helical spring encircling the sleeve in the region between the first and the second sleeve engaging arms, the helical spring further comprising a bias arm for contacting a surface within the well to apply the bias force.

7. The firearm of claim 1 wherein the firearm further comprises a barrel, the spare magazine having a first end adapted for operative engagement with the firearm at an active magazine receiver, wherein the first end of the spare magazine is oriented within the well with the first end facing away from the barrel.

8. The firearm of claim 7 wherein the orientation of the spare magazine within the well is adapted to direct motion of the spare magazine from within the well to the active magazine receiver.

9. The firearm of claim 1 wherein a longitudinal axis of the spare magazine is parallel to a longitudinal axis of the firearm.

10. A buttstock removably attachable to a firearm for providing integral spare magazine storage therein, comprising:

the buttstock defining a well in a bottom surface thereof, for receiving the spare magazine disposed horizontally within the well; and a pivotable latch disposed within the well for engaging the spare magazine to releasably retaining the spare magazine within the well.

* * * * *